US012110461B2

(12) United States Patent
Falcade, Jr.

(10) Patent No.: US 12,110,461 B2
(45) Date of Patent: Oct. 8, 2024

(54) SOLID AND LIQUID WASTE GASIFIER

(71) Applicant: BUMERANGUE COMERCIO E SERVICOS DE TECNOLOGIAS AMBIENTAIS LTDA, Porto Alegre (BR)

(72) Inventor: Arildo Falcade, Jr., Porto Alegre (BR)

(73) Assignee: BUMERANGUE COMERCIO E SERVICOS DE TECNOLOGIAS AMBIENTAIS LTDA, Porto Alegre (BR)

( * ) Notice: Subject to any disclaimer, the term of this patent is extended or adjusted under 35 U.S.C. 154(b) by 813 days.

(21) Appl. No.: 17/283,510

(22) PCT Filed: Sep. 13, 2019

(86) PCT No.: PCT/BR2019/050396
§ 371 (c)(1),
(2) Date: Apr. 7, 2021

(87) PCT Pub. No.: WO2020/073106
PCT Pub. Date: Apr. 16, 2020

(65) Prior Publication Data

US 2021/0395627 A1 Dec. 23, 2021

(30) Foreign Application Priority Data

Oct. 8, 2018 (BR) ..... BR202018070746-4

(51) Int. Cl.
*C10J 3/84* (2006.01)
*C10J 3/00* (2006.01)
*C10J 3/74* (2006.01)

(52) U.S. Cl.
CPC ..... *C10J 3/84* (2013.01); *C10J 3/005* (2013.01); *C10J 3/007* (2013.01); *C10J 3/74* (2013.01);

(Continued)

(58) Field of Classification Search
CPC .. C10J 3/84; C10J 2200/15; C10J 2300/0946; C10J 2300/1625
See application file for complete search history.

(56) References Cited

U.S. PATENT DOCUMENTS 4,439,209 A 3/1984 Werding et al.
2012/0006669 A1* 1/2012 Bronshtein ..... F23G 5/0276 202/100

(Continued)

FOREIGN PATENT DOCUMENTS

EP 0765928 A2 4/1997
IT UA20163609 A1 11/2017
WO WO 2008129267 A2 10/2008

OTHER PUBLICATIONS

Gasification Technologies Council. (2011) *Gasification: The Waste-to-Energy Solution* [Brochure] 2011, 15 pages. https://www.globalsyngas.org/uploads/downloads/GTC_Waste_to_Energy.pdf.

*Primary Examiner* — Matthew J Merkling
(74) *Attorney, Agent, or Firm* — BACON&THOMAS,PLLC

(57) ABSTRACT

A solid and liquid waste gasifier has a reactor that includes a fixed chamber and an alumina (aluminium oxide) refractory coating, provided with an automatic energy cell feeder and having, inside the fixed chamber, a rotary steel tube which is coupled to one of the ends of the fixed chamber, said rotary tube having a surface containing holes, a screw on its inside surface and a second screw on its outside surface, which rotates juxtaposed to the inside tubular body wall, ensuring the ashes are moved to be released in an automatic device, said gasifier being provided with sensors, the data from which is sent to a programmable logic controller for activation of the mechanical elements.

1 Claim, 3 Drawing Sheets

(52) U.S. Cl.
CPC .... *C10J 2200/15* (2013.01); *C10J 2300/0946* (2013.01); *C10J 2300/1625* (2013.01)

(56) References Cited

U.S. PATENT DOCUMENTS

| | | | | |
|---|---|---|---|---|
| 2012/0217442 | A1 | 8/2012 | Jeney | |
| 2013/0036746 | A1 | 2/2013 | Graham | |
| 2015/0322347 | A1 * | 11/2015 | Streitenberger | C10B 49/02 201/16 |

* cited by examiner

SOLID AND LIQUID WASTE GASIFIER

BACKGROUND OF THE INVENTION

Field of the Invention

The present utility model describes a solid and liquid waste gasifier, that reaches temperatures up to 900° C., having a rotary reactor coated with an alumina (aluminum oxide) refractory material, ensuring more efficient homogenization and thermal exchange, with shorter processing time, and having an automatic ash release device.

Brief Summary of the Related Art

Gasification is a unique process that transforms any carbon-based material, such as solid urban waste, into energy, without burning it. Instead, these materials are converted into gas by the creation of a chemical reaction. This reaction combines carbon-based materials (known as raw materials) with small amounts of air or oxygen, breaking them down into simple molecules, mainly a mixture of carbon monoxide (CO) and hydrogen (H), and removing pollutants and impurities. What remains is a clean environment called syngas, or synthetic gas, which in turn can be converted into electricity and also into other valuable products.

Urban solid and liquid waste resulting from activities of human, industrial, hospital, commercial, agricultural and services origin can become inputs for other activities. Through gasification, waste is no longer discarded, and becomes raw material for a gasifier. Instead of paying to dispose and manage waste in a landfill, the waste can be used as a raw material for gasification, thus reducing costs, and converting waste into electricity and fuel. (GTC—Gasification Technologies Council. Gasification the Waste to Energy Solution. Texas, United States, August, 2014. Available from: http://www.gasification-syngas.org/uploads/downloads/GTC_Waste_to_Energy.pdf Accessed on Oct/02/2018.

The state of the art describes several models of gasifiers that differ in relation to the supply of heat (directly heated, indirectly heated), pressure (atmospheric, pressurized), to the gasification agent (air, oxygen, steam, (plasma), reactor type (moving, bubbling, circulating bed), temperature (below or above 900° C.), ash (dry ash or vitrified slag) and energy recovery.

SUMMARY OF THE INVENTION

However, as a way to optimize the processing time and increase thermal exchange, the object of the present utility model is a solid and liquid waste gasifier, equipped with a reactor that includes a fixed chamber and a refractory coating of alumina (aluminum oxide), provided with an automatic energy-cell power supply, having in the internal region of the fixed chamber a rotating steel tube that attaches to one of the ends of the fixed chamber, said rotating tube having a perforated surface, a helicoid on the internal surface and a second helicoid on the external surface that rotates juxtaposed to the wall of the internal tubular body, ensuring the displacement of the ashes for releasing in an automatic device, said gasifier provided with sensors whose data are sent to a programmable logic control unit to activate the mechanical elements.

A gasifier equipped with a rotating tube adjacent to the reactor and which moves the ashes to the outlet, eliminating the need for a technical stop for cleaning, is a characteristic of the utility model.

A gasifier with a high chemical reaction power thanks to its construction with an alumina refractory is a characteristic of the utility model.

BRIEF DESCRIPTION OF THE DRAWINGS

In order to better describe the technical-constructive characteristics of the gasifier object of this utility model, the following figures are detailed.

DETAILED DESCRIPTION OF THE PREFERRED EMBODIMENTS

Figure 1:
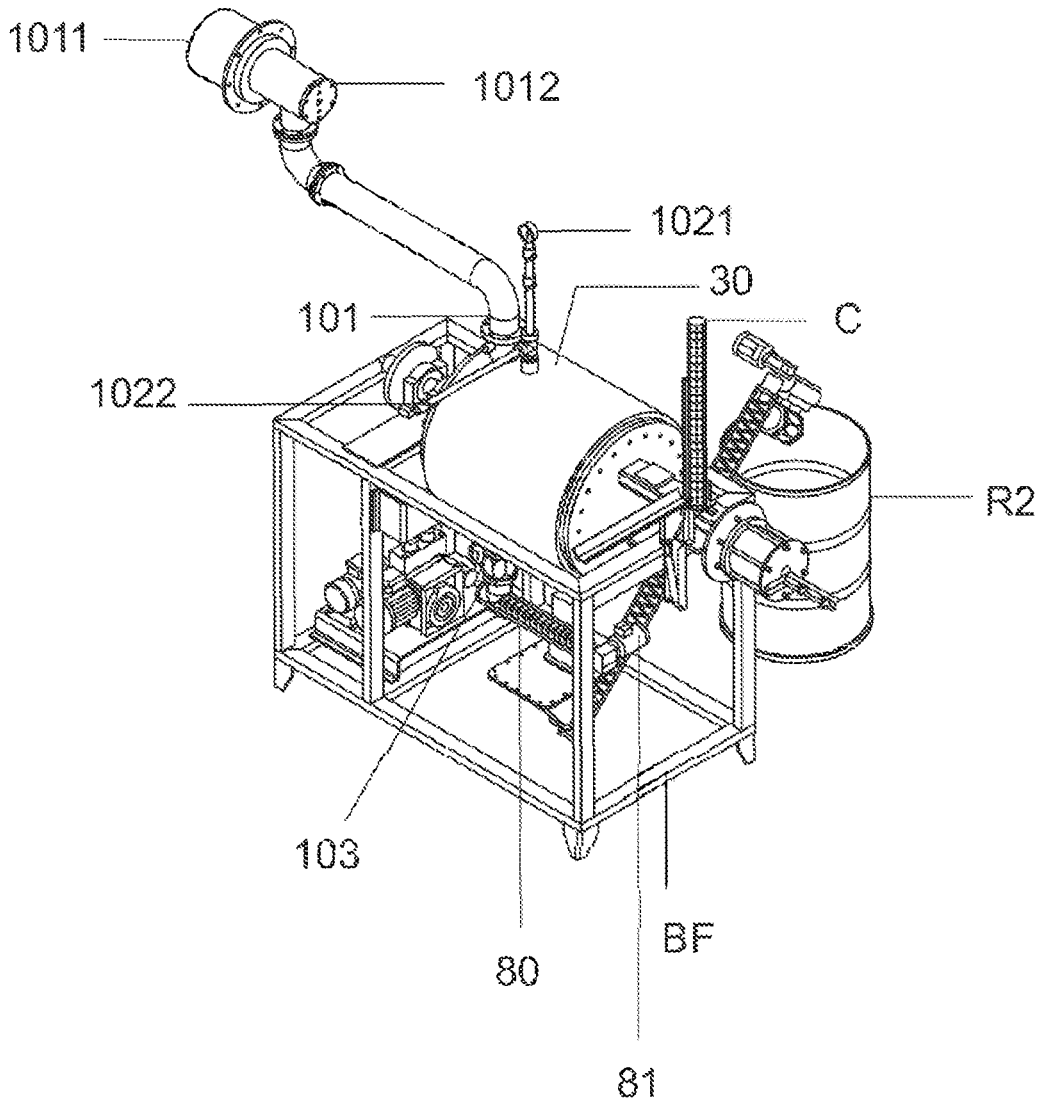
FIG. 1 shows a perspective view of the gasifier assembled.
Figure 2:
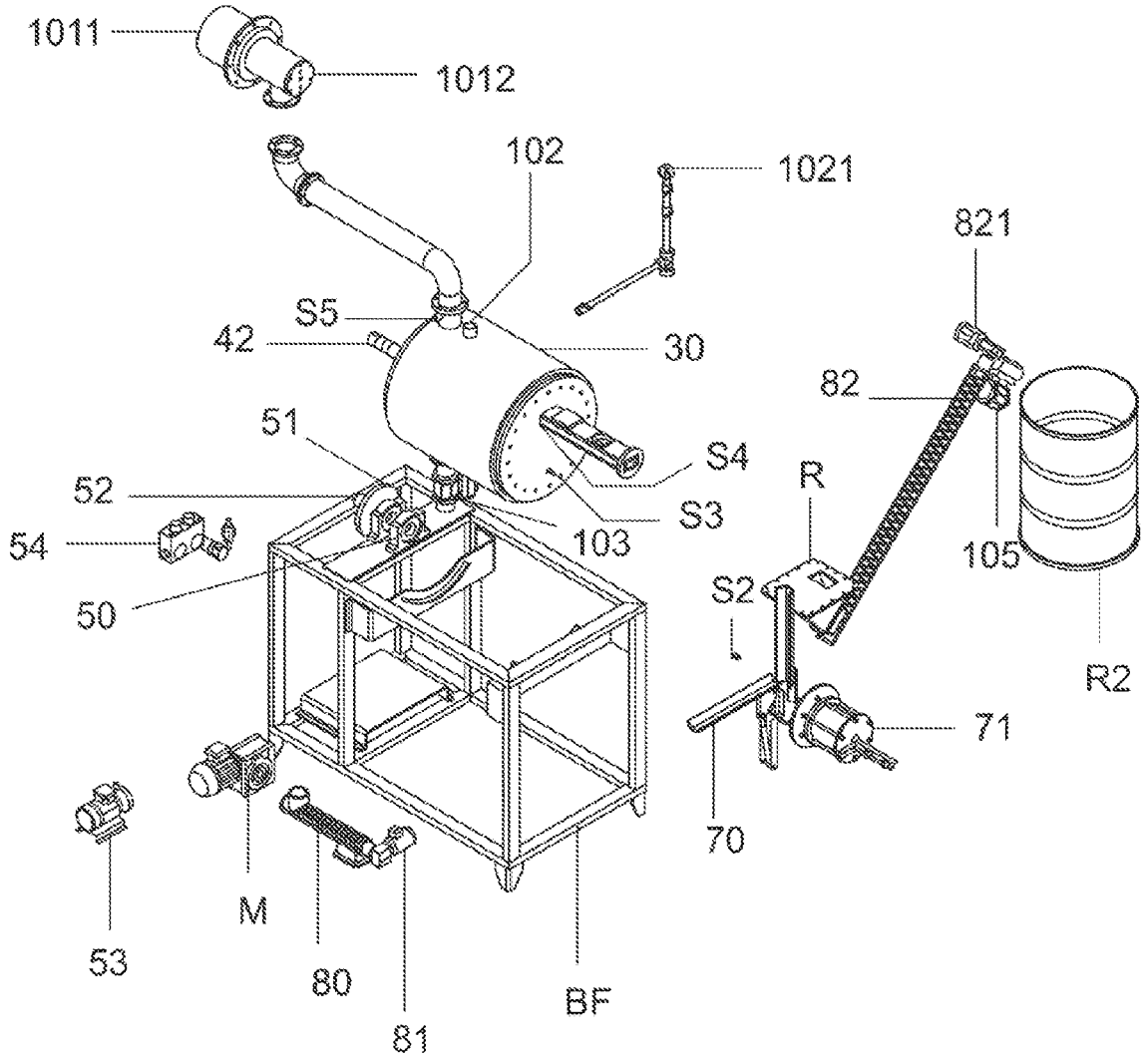
FIG. 2 shows an exploded view.
Figure 3:
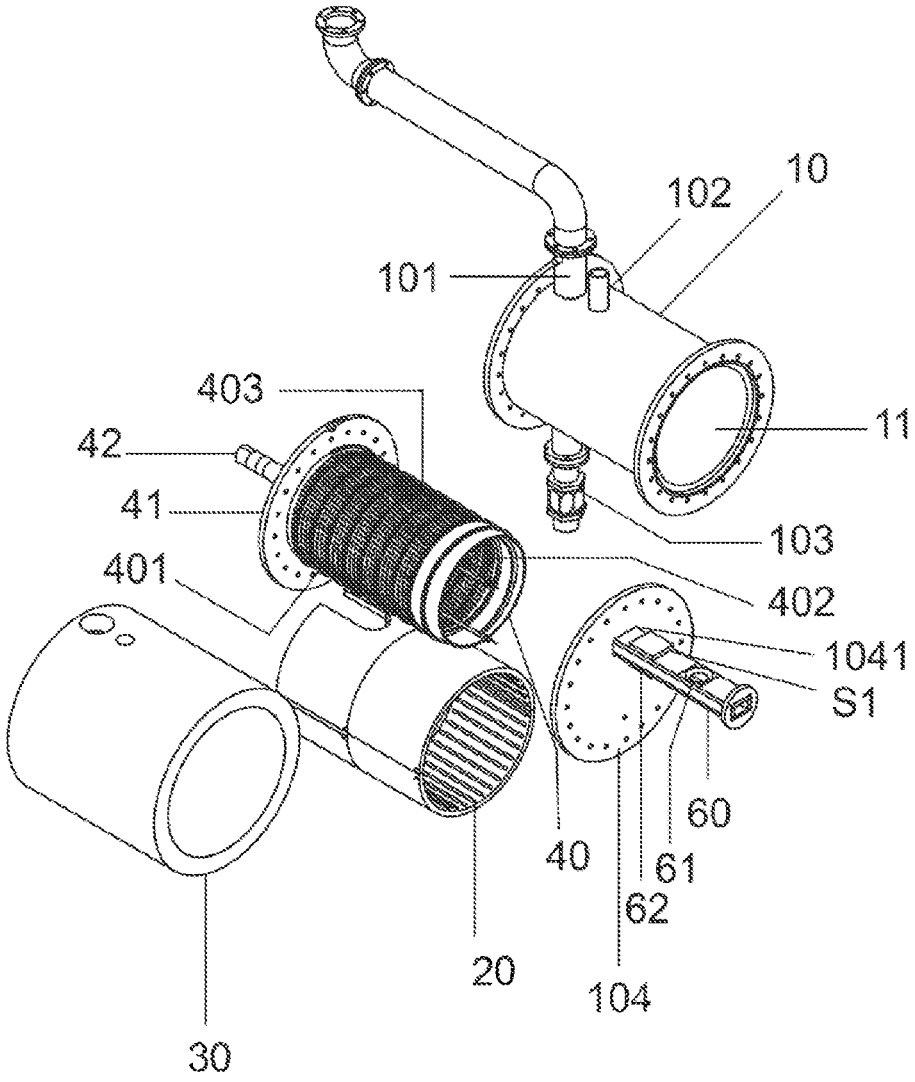
FIG. 3 shows details of the reactor and the rotating tube.

The term waste will be used generically, in the context of the present utility model, to designate solid and liquid waste, preferably in the form of energy cells, which are solid billets of dry and pressed waste.

The gasifier, object of the present utility model, comprises a reactor that includes a fixed tubular steel chamber (10) that has in its internal region an internal refractory tubular body (11) made of alumina ceramic where the pyrolysis reaction and generation of the synthetic gas take place.

In the fixed chamber (10) a top opening is provided for the exit of the synthetic gas (101) generated in the pyrolysis reaction, a top opening for controlling the internal pressure (102) and a bottom opening for the exit of the ashes (103), said fixed chamber (10), that has on the external surface an arrangement of electrical resistors (20) covered with a rigid ceramic-fiber cover (30).

At the gas outlet (101), a piping with a double connector is installed, being one path (1011) whose piping is coupled for the release of the synthetic gas and a second path (1012) for the entry of compressed air into the fixed chamber (10).

To the internal pressure control output (102) a double connector is coupled in a way that in one path a manometer (1021) and an outlet for sampling synthetic gas (1022) are installed.

In the internal region of the refractory tubular body (11) a rotating steel tube (40) is disposed that is coupled to one end of the fixed chamber (10) through a sealing pillow block (41) to provide the sealing of the vacuum system in the fixed chamber (10), in said sealing bearing (41) being disposed an internally-hollowed drive shaft (42) for cooling the pillow blocks and bearings.

On the surface of the rotating steel tube (40), perforations (401), and a helicoid (402) are arranged on the internal surface of said tube (40) that transports and revolves the waste, increasing the gasification capacity and promoting better thermal exchange, and a second helicoid (403) on the external surface of the tube (40) that rotates juxtaposed to the wall of the internal tubular body (11), carrying the ashes that are formed during the reaction in the fixed chamber (10), said ashes being moved to the exit (103).

The rotary movement of the steel tube (15), effected by a motor (M), is obtained by means of a mechanical assembly supported on a fixed base (BF), said mechanical assembly that comprises a set of pillow blocks (50) that support the rotating tube (40), a chain gear (51) and a rotary connector (52) with an inlet and outlet for the shaft cooling water (42) and bearings made by means of a centrifugal pump (53) that drives a radiator (54) coupled to said connector (52).

At the opposite end of the fixed chamber (10), a sealing pillow block (104) is fixed where an opening (1041) is provided in which a feed chute (60) is installed, which has close to the free end a fractioning region (61) of the energy cell (C), where a horizontal displacement piston acts on the vertically arranged cell (C), fractionating the cell (C) and pushing it into a heating pre-chamber with a substantially conical shape (62) and then to the internal region of the fixed chamber (10).

The conical shape of the heating pre-chamber (62) provides the maintenance of the pressure system in the fixed chamber (10), and due to the fractional energy cells (C) promote the sealing of the external air inlet in the opening (1041) guaranteed by the continuous pressure exerted by the piston associated with the heating.

A temperature sensor (S1) is provided in the feeding chute (60), which controls the temperature of the pre-heating chamber (62), releasing the pre-chamber supply (62) when the temperature determined in the control unit of the gasifier is reached.

For the supply of the fixed chamber (10) of the gasifier, an automatic feeder (70) of energy cells (C) is provided coupled to the feed chute (60), said feeder (70) in the form of a chute where an optical sensor (S2) is installed that identifies the presence or absence of the energy cell (C) and sends the signal to the control unit which, in case it does not detect the presence of an energy cell (C) in the feeder (70), it triggers a pneumatic piston (71) that carries an energy cell (C) and positions it in an upright position, in order to be sent to the feed chute (60).

In the bottom ash outlet opening (103), a valve (104) is provided, activated by the control unit, said valve (104) which, when opened, releases ash into a horizontal helical thread (80) driven by a gearmotor (81) that conducts the ashes to an intermediate reservoir (R).

In the intermediate reservoir (R) a helical thread with an upward slope (82) is provided, driven by a gearmotor (821), said helical thread (82) which has in the extreme end a valve (105) activated by the control unit that, when opened, removes the ashes from the intermediate reservoir (R) into a container (R2), in order for the ashes to be packed and be given the appropriate destination.

The programmable logic control unit, at predetermined time periods, shuts off the valve (104) of the ash outlet (103). When the valve (104) is closed, the valve (105) is activated, and the ashes from the intermediate reservoir (R) are transferred to the container (R2) by the displacement of the upward thread (82). When the valve (105) is shut, the valve (104) is opened.

The pre-heating of the gasifier, done by the electrical resistors (20), is controlled by means of temperature sensors (S3), (S4) and (S5) installed, respectively, in the lower level of the rotating tube (40), at the center the rotating tube (40) and in the top gas outlet opening (101), said sensors send the data to the programmable logic control unit.

The synthetic gas produced in the fixed chamber (10) is released through the top opening (101) where a pipe is attached that sends the synthetic gas to a conventional peripheral structure that basically comprises a combustion chamber where thermal energy is generated to feed boilers, turbines, incinerators, among others.

The invention claimed is:

1. A solid and liquid waste gasifier equipped with a reactor that includes a fixed steel tubular chamber with:

a top gas exit opening for exit of a synthetic gas and a pipe with a double one-way connector installed in the top gas outlet opening and to which is connected a pipe for the release of the synthetic gas and to provide a second path for an inflow of compressed air into the fixed steel tubular chamber;

a top pressure-controlling opening for controlling an internal pressure and to which a double connector is coupled that includes a first path installed with a manometer and another path that provides an outlet for collection of samples of the synthetic gas; and a bottom ash outlet opening for exit of ashes formed during a reaction in the fixed steel tubular chamber, said fixed steel tubular chamber further having on an external surface an arrangement of electrical resistors covered with a rigid ceramic-fiber cover, and a fixed base, wherein:

a) the fixed steel tubular chamber has an internal region provided with an internal refractory tubular body made of alumina ceramic;

b) a rotating steel tube is disposed in the internal region of the internal refractory tubular body, said rotating steel tube being coupled to one end of the fixed steel tubular chamber through a sealing pillow block provided with an internally-hollow drive shaft, the rotating steel tube having an arrangement of perforations, a first helicoid on an internal surface of said rotating steel tube to transport waste as the rotating steel tube is rotated, and a second helicoid on an external surface of the rotating steel tube to transport the ashes and that is juxtaposed to a wall of the internal refractory tubular body;

c) a mechanical assembly comprising a set of pillow blocks supports the rotating steel tube, the rotating steel tube being driven by a motor, a chain gear and a rotary connector having an inlet and outlet for shaft and bearing cooling water supplied by a centrifugal pump and a radiator coupled to said rotary connector;

d) a sealing pillow block is provided at an end of the fixed steel tubular chamber, the sealing pillow block having a feed chute opening for installation of a feed chute, the feed chute having a free end in proximity to a fractioning region of an energy cell;

e) an automatic feeder of energy cells is coupled to the feed chute and equipped with a pneumatic piston that moves the energy cell into the feed chute to a heating pre-chamber having a substantially conical shape and then into the internal region of the fixed steel tubular chamber;

f) the bottom ash outlet opening is provided with a first valve, activated by a programmable logic control unit, said first valve when opened releasing the ashes into a horizontal helical thread driven by a gear motor that conducts the ashes to an intermediate reservoir;

g) a second valve activated by the programmable logic control unit is provided at an extreme end of said horizontal helical thread to, when opened, remove the ashes from the intermediate reservoir into a container;

h) a first temperature sensor is provided for controlling a temperature of the heating pre-chamber, an optical sensor is installed in the automatic feeder to identify a presence or absence of the energy cell, said temperature sensors and optical sensor sending data to the programmable logic control unit; a second temperature sensor is installed on a lower level of the rotating steel tube; a third temperature sensor is installed at a center of the rotating tube, and a fourth temperature sensor is installed in the top gas exit opening of the fixed steel tubular chamber, said optical sensor and said temperature sensors sending data to the programmable logic control unit.

* * * * *